US005898962A

United States Patent [19]

McNeal

[11] Patent Number: 5,898,962

[45] Date of Patent: May 4, 1999

[54] PILLOW WITH PHOTOGRAPH DISPLAYS

[76] Inventor: Ella J. McNeal, 3107 Poplar Ave., Tampa, Fla. 33603

[21] Appl. No.: 08/927,118

[22] Filed: Aug. 29, 1997

[51] Int. Cl.[6] ..... A47G 9/00

[52] U.S. Cl. ..... 5/639; 5/485; 5/490; 40/661; 40/776

[58] Field of Search ..... 5/485, 490, 639; 40/661, 725, 766, 776; 446/321, 333, 391

[56] References Cited

U.S. PATENT DOCUMENTS

| | | | |
|---|---|---|---|
| 811,334 | 1/1906 | Smigel | 40/725 X |
| 2,177,204 | 10/1939 | Buzick et al. | 40/725 X |
| 3,055,133 | 9/1962 | Anderson | 40/586 |
| 4,108,227 | 8/1978 | Bonner | 40/661 X |
| 4,309,784 | 1/1982 | Cohen | 5/639 |
| 4,688,286 | 8/1987 | Miker, Jr. | 5/485 X |
| 4,761,872 | 8/1988 | Buettner et al. | 5/636 X |
| 5,072,429 | 12/1991 | Mair | 5/639 X |
| 5,111,544 | 5/1992 | Graebe | 5/485 X |
| 5,515,563 | 5/1996 | Chao | 5/632 |

*Primary Examiner*—Brian K. Green
*Assistant Examiner*—Robert G. Santos

[57] ABSTRACT

A new pillow with photograph displays for displaying favorite photographs on a pillow for viewing. The inventive device includes removable cover for receiving a foam rubber padding within an open end thereof. A plurality of clear pockets are secured to a front surface of the removable cover. The pockets each have a clear front window and peripheral side walls and a bottom wall. The pockets each have an open upper end for receiving photographs therethrough for displaying through the clear front window.

3 Claims, 2 Drawing Sheets

PILLOW WITH PHOTOGRAPH DISPLAYS

BACKGROUND OF THE INVENTION

1. Field of the Invention

The present invention relates to photograph displays and more particularly pertains to a new pillow with photograph displays for displaying favorite photographs on a pillow for viewing.

2. Description of the Prior Art

The use of photograph displays is known in the prior art. More specifically, photograph displays heretofore devised and utilized are known to consist basically of familiar, expected and obvious structural configurations, notwithstanding the myriad of designs encompassed by the crowded prior art which have been developed for the fulfillment of countless objectives and requirements.

Known prior art photograph displays include U.S. Pat. No. 5,382,187 to Wilson; U.S. Pat. No. 5,403,224 to Gintling; U.S. Pat. No. Des. 338,362 to Schlosser; U.S. Pat. No. 4,020,586 to Benner; U.S. Pat. No. 5,380,206 to Asprey; and U.S. Pat. No. 5,405,266 to Frank et al.

While these devices fulfill their respective, particular objectives and requirements, the aforementioned patents do not disclose a new Pillow with photograph displays. The inventive device includes a removable cover for receiving a foam rubber padding within an open end thereof. A plurality of clear pockets are secured to a front surface of the removable cover. The pockets each have a clear front window and peripheral side walls and a bottom wall. The pockets each have an open upper end for receiving photographs therethrough for displaying through the clear front window.

In these respects, the pillow with photograph displays according to the present invention substantially departs from the conventional concepts and designs of the prior art, and in so doing provides an apparatus primarily developed for the purpose of displaying favorite photographs on a pillow for viewing.

SUMMARY OF THE INVENTION

In view of the foregoing disadvantages inherent in the known types a pillow for viewing of photograph displays now present in the prior art, the present invention provides a new pillow with photograph displays construction wherein the same can be utilized for displaying favorite photographs on.

The general purpose of the present invention, which will be described subsequently in greater detail, is to provide a new Pillow with photograph displays apparatus and method which has many of the advantages of the photograph displays mentioned heretofore and many novel features that result in a new Pillow with photograph displays which is not anticipated, rendered obvious, suggested, or even implied by any of the prior art photograph displays, either alone or in any combination thereof.

To attain this, the present invention generally comprises a foam rubber padding having a protective cover disposed thereover. A removable cover receives the foam rubber padding within an open end thereof. A plurality of clear pockets are secured to a front surface of the removable cover. The pockets each have a clear front window and peripheral side walls and a bottom wall. The peripheral side walls and the bottom wall are fixedly secured to the front surface of the removable cover. The pockets each have an open upper end for receiving photographs therethrough for displaying through the clear front window. The open upper end has a zipper closure extending between upper ends of peripheral side walls for selectively closing the open upper end for safe containment of the photographs within the pockets.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pillow with photograph displays apparatus and method which has many of the advantages of the photograph displays mentioned heretofore and many novel features that result in a new pillow with photograph displays which is not anticipated, rendered obvious, suggested, or even implied by any of the prior art photograph displays, either alone or in any combination thereof.

It is another object of the present invention to provide a new pillow with photograph displays which may be easily and efficiently manufactured and marketed.

It is a further object of the present invention to provide a new pillow with photograph displays which is of a durable and reliable construction.

An even further object of the present invention is to provide a new pillow with photograph displays which is susceptible of a low cost of manufacture with regard to both materials and labor, and which accordingly is then susceptible of low prices of sale to the consuming public, thereby making such pillow with photograph displays economically available to the buying public.

Still yet another object of the present invention is to provide a new pillow with photograph displays which provides in the apparatuses and methods of the prior art some of the advantages thereof, while simultaneously overcoming some of the disadvantages normally associated therewith.

Still another object of the present invention is to provide a new pillow with photograph displays for displaying favorite photographs on a pillow for viewing.

Yet another object of the present invention is to provide a new pillow with photograph displays which includes a removable cover for receiving a foam rubber padding within an open end thereof. A plurality of clear pockets are secured to a front surface of the removable cover. The pockets each have a clear front window and peripheral side walls and a bottom wall. The pockets each have an open upper end for receiving photographs therethrough for displaying through the clear front window.

Still yet another object of the present invention is to provide a new pillow with photograph displays that fulfills the need for an eye-catching way of displaying photographs.

Even still another object of the present invention is to provide a new pillow with photograph displays that provides a decorative touch as it is displayed on various furniture items.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
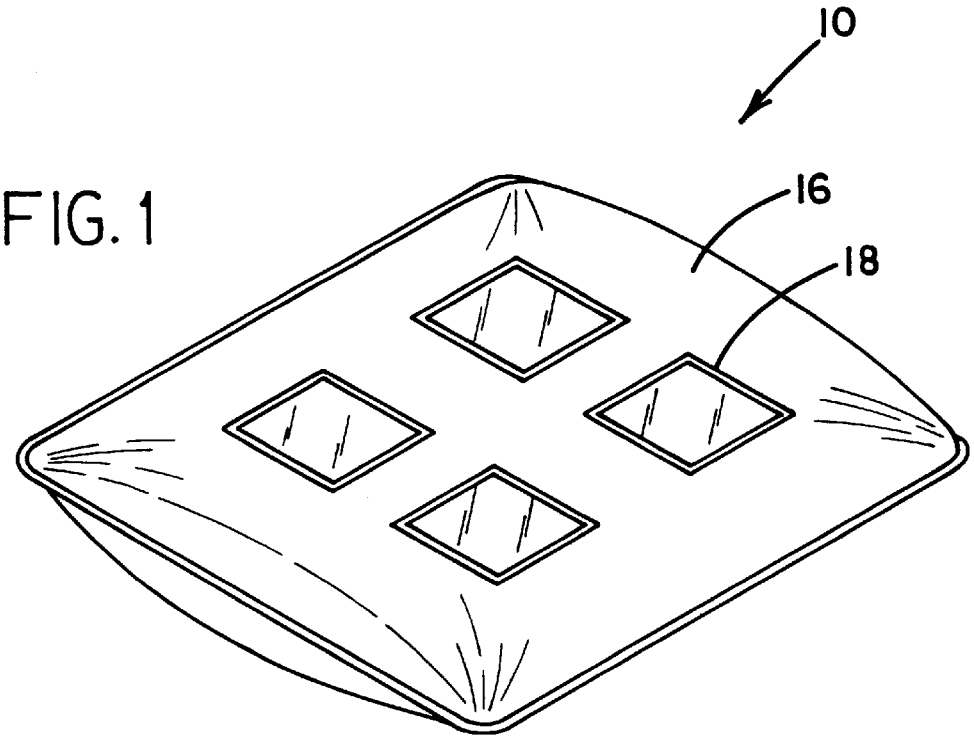
FIG. 1 is a perspective view of a new pillow with photograph displays according to the present invention.
Figure 2:
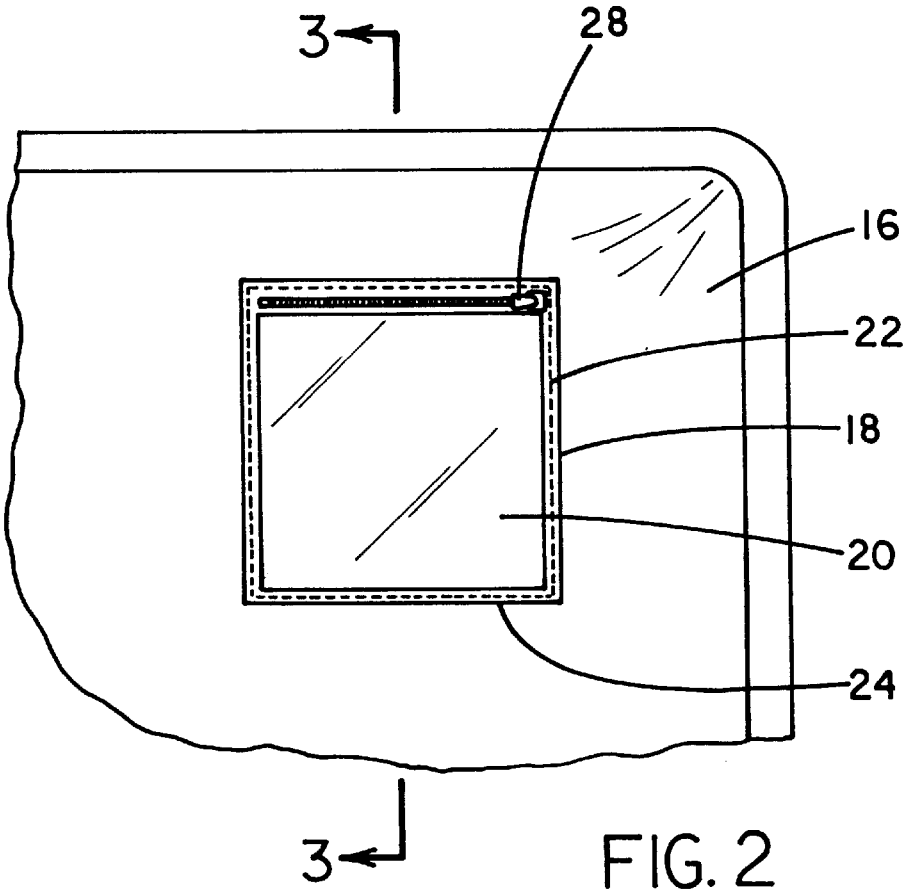
FIG. 2 is a partial top view of the present invention illustrating one of the photograph pockets thereof.
Figure 3:
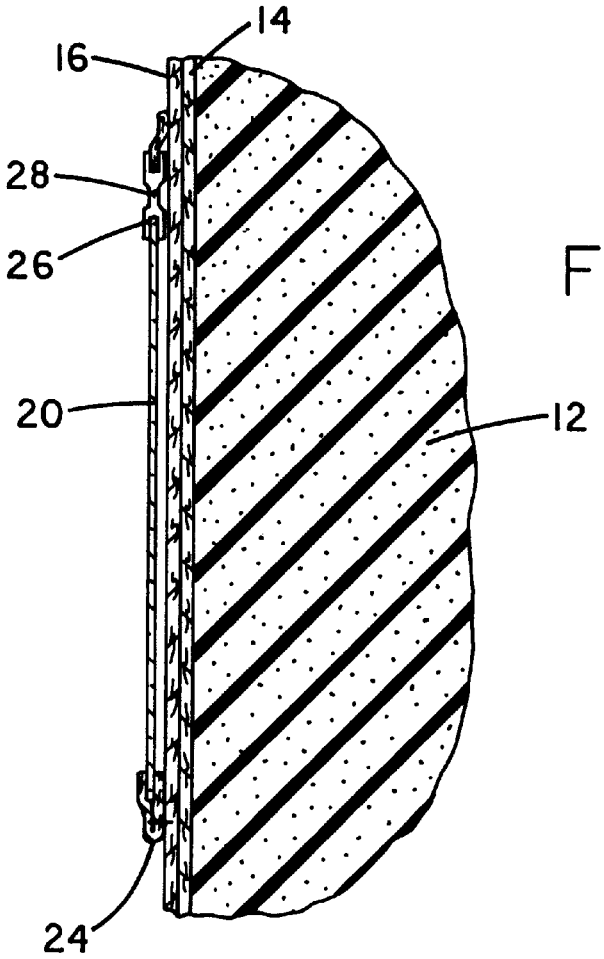
FIG. 3 is a cross-sectional view of the present invention as taken along line 3—3 of FIG. 2.

With reference now to the drawings, and in particular to FIGS. 1 through 4 thereof, a new pillow with photograph displays embodying the principles and concepts of the present invention and generally designated by the reference numeral 10 will be described.

As best illustrated in FIGS. 1 through 4, the pillow with photograph displays 10 comprises a foam rubber padding 12 having a protective cover 14 disposed thereover. The foam rubber padding 12 could be replaced by any other suitable material used for pillows.

A removable cover 16 receives the foam rubber padding 12 within an open end thereof. The removable cover 16 is preferably fabricated of a washable material. Alternately, a permanent cover could be fixedly coupled with the padding 12 wherein the permanent cover is fabricated of a decorative material.

A plurality of clear pockets 18 are secured to a front surface of the removable cover 16. The pockets 18 each have a clear front window 20 and peripheral side walls 22 and a bottom wall 24. The peripheral side walls 22 and the bottom wall 24 are fixedly secured to the front surface of the removable cover 16. The pockets 18 each have an open upper end 26 for receiving photographs therethrough for displaying through the clear front window 20. The open upper end 26 has a zipper closure 28 extending between upper ends of peripheral side walls 22 for selectively closing the open upper end 26 for safe containment of the photographs within the pockets 18.

Figure 4:
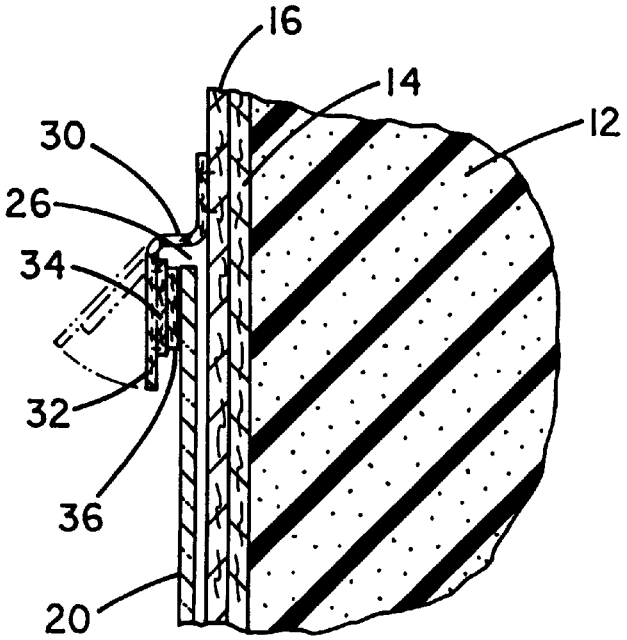
FIG. 4 is a cross-sectional view of an alternate embodiment of the present invention.

Alternately, as viewed in FIG. 4, the zipper closure 28 would be replaced with an alternate means of closure. In this embodiment, a flap 30 would be secured to the removable cover 16 disposed above the open upper end 26 of each of the pockets 18. The flap 30 has a lower end 32 that extends over the open upper end 26. The flap 30 has a nylon fastener 34 disposed on an interior surface thereof with a corresponding nylon fastener 36 disposed on an upper edge of the window 20 for securing the flap 30 over the open upper end 26.

In use, the user would open the open upper ends 26 of the pockets 18 to place a photo or the like therein. The photos could be placed within the pockets 18 with or without their frames. The pillow could then be prominently displayed for viewing by interested parties.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pillow with photograph display pockets for displaying photographs on an exterior surface of the pillow comprising, in combination:

a pillow having padding material enclosed in an interior thereof, said pillow having a protective covering;

a pillow cover having an exterior surface and an interior for removably receiving the pillow;

four pockets, each pocket being secured to an individual quadrant of the exterior surface of the pillow cover such that each pocket is positioned proximate a respective corner of the pillow cover and spaced from each corner and further from each side of a periphery of the pillow cover a distance equal to a width of the pockets, each pocket having a transparent front window, peripheral side walls and a bottom wall mounted to a strip which is in turn stitchedly coupled to the pillow cover, the peripheral side walls and the bottom wall being fixedly secured to the exterior surface of the pillow cover, each pocket having an open end for receiving photographs therethrough such that the photographs are positionable within each pocket for displaying the photographs through the transparent window such that each picture is held in place by the peripheral side walls and bottom wall of the pocket;

closure means for selectively closing said open end of each pocket individually such that a photograph is insertable and removable from each pocket without disturbing photographs located in the other of said pockets, said closure means being provided on each of said pockets.

2. The pillow with photograph display pockets of claim 1, wherein the closure means includes a first zipper portion coupled to an edge of said open end of each pocket and a second zipper portion coupled to the exterior surface of the pillow cover adjacent the first zipper portion such that the first zipper portion is removably couplable to the second zipper portion, whereby the open end of each pocket is closable independent of the other of said pockets.

3. The pillow with photograph display pockets of claim 1, wherein the closure means includes a respective flap disposed from the exterior surface of the pillow cover adjacent the open end of each pocket, each said flap being for folding over said open end, each open end having one of a hook portion and a loop portion coupled to an outside of the pocket proximate said open end such that said flap contacts said one of the hook portion and the loop portion when said flap is folded over, each respective flap having a complimentary one of the hook portion and the loop portion coupled to a surface of the flap such that the one of the hook portion and the loop portion engages a complimentary one of the hook portion and the loop portion whereby the flap is removably coupled to an outside of the pocket such that the open end of each said pocket is closable independent of the other of said pockets.

* * * * *